US007269989B2

(12) United States Patent
Joseph et al.

(10) Patent No.: US 7,269,989 B2
(45) Date of Patent: Sep. 18, 2007

(54) METHOD OF USING A TOOL TO FORM ANGLED ORIFICES IN A METERING ORIFICE DISC

(75) Inventors: J. Michael Joseph, Newport News, VA (US); Samuel A. Gruber, Natrona Heights, PA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 490 days.

(21) Appl. No.: 10/807,340

(22) Filed: Mar. 24, 2004

(65) Prior Publication Data

US 2005/0210674 A1 Sep. 29, 2005

(51) Int. Cl.
*B21D 28/26* (2006.01)
*B21D 28/34* (2006.01)

(52) U.S. Cl. ..... 72/334; 72/325; 29/890.142; 83/689

(58) Field of Classification Search ..... 72/325, 72/334, 335, 479; 29/890.142, 890.143, 29/896.6; 83/689, 696, 52, 55
See application file for complete search history.

(56) References Cited

U.S. PATENT DOCUMENTS 1,801,153 A 4/1931 Gray
1,801,453 A 4/1931 Patterson
2,180,545 A * 11/1939 Parsons et al. ..... 72/327
2,846,901 A 8/1958 Baule
2,846,902 A 8/1958 Cowley
3,656,379 A 4/1972 Clark
3,678,941 A 7/1972 Dixon
4,012,975 A * 3/1977 LaLone ..... 83/140
4,739,687 A * 4/1988 Wanner et al. ..... 83/688
4,771,663 A 9/1988 Naito et al.
6,009,787 A 1/2000 Hänggi
6,109,086 A 8/2000 Gambrel et al.
6,678,955 B2 1/2004 Takeshita et al.

FOREIGN PATENT DOCUMENTS

JP 63-224820 * 9/1988
JP 5-293557 * 9/1993
SU 863202 * 9/1981

* cited by examiner

*Primary Examiner*—Daniel C. Crane

(57) ABSTRACT

A method of using a tool for punching orifice that has wall surfaces extending at an angle relative to a generally planar surface of a workpiece. The method includes sequentially forming two spaced apart impressions formed in the workpiece between first and second generally planar surfaces spaced apart along a longitudinal axis of the workpiece. The two spaced apart impressions form a first orifice wall surface disposed at an obtuse angle with respect to the generally planar surface facing the tool and a second orifice wall surface disposed at an acute angle with respect to the generally planar surface, and coincidental with the punching process, a retention arrangement that secures the workpiece during the forming of the orifice.

13 Claims, 8 Drawing Sheets

FIG. 4B
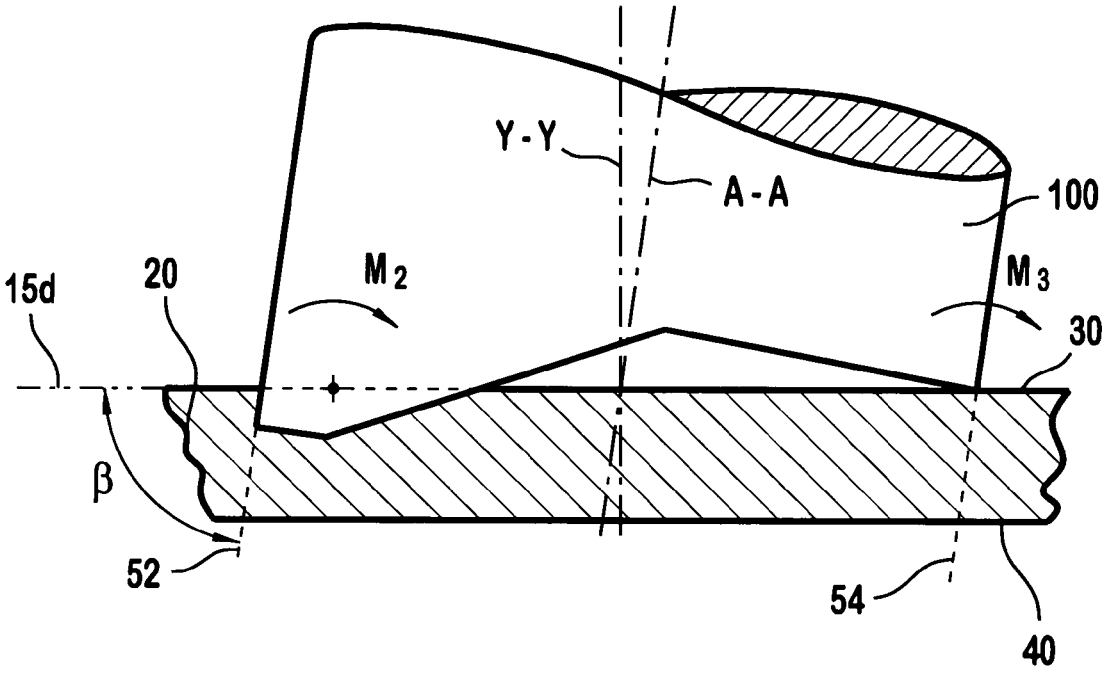
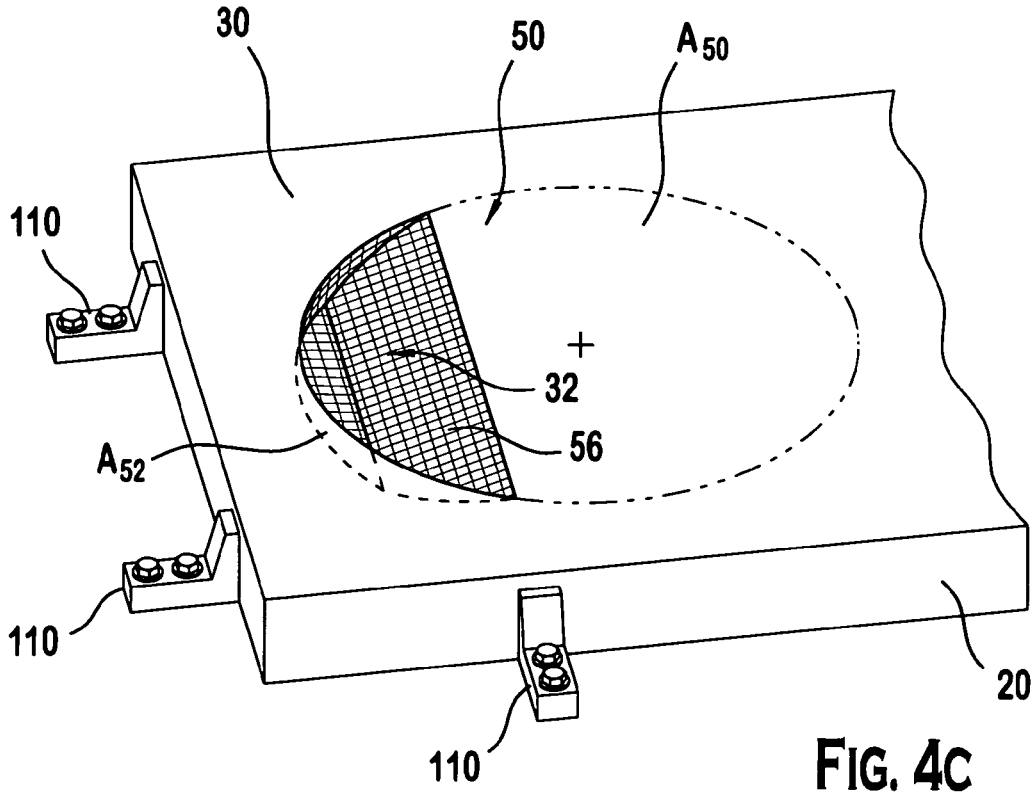
FIG. 4C

FIG. 4D
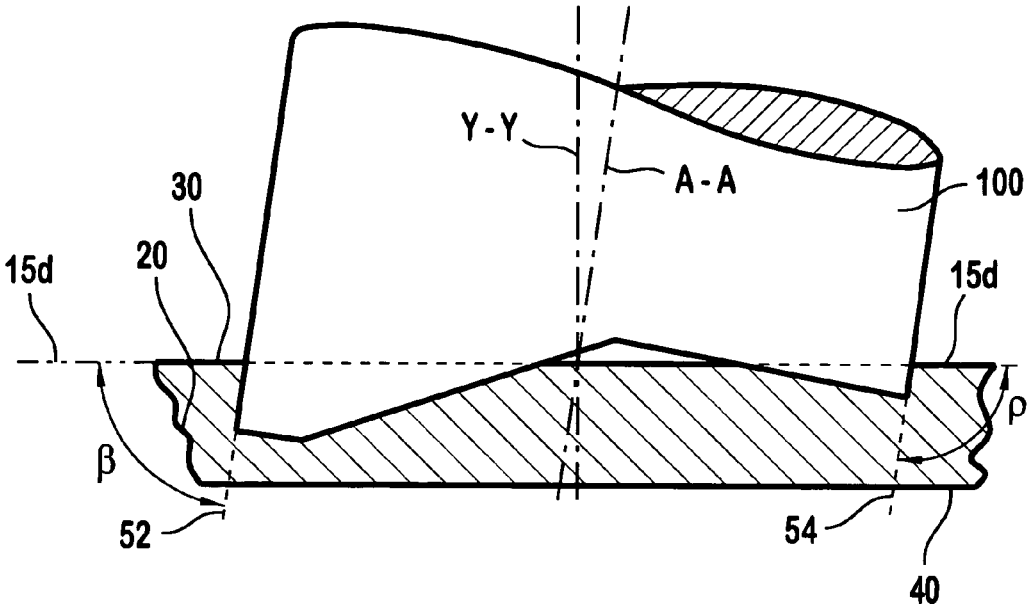
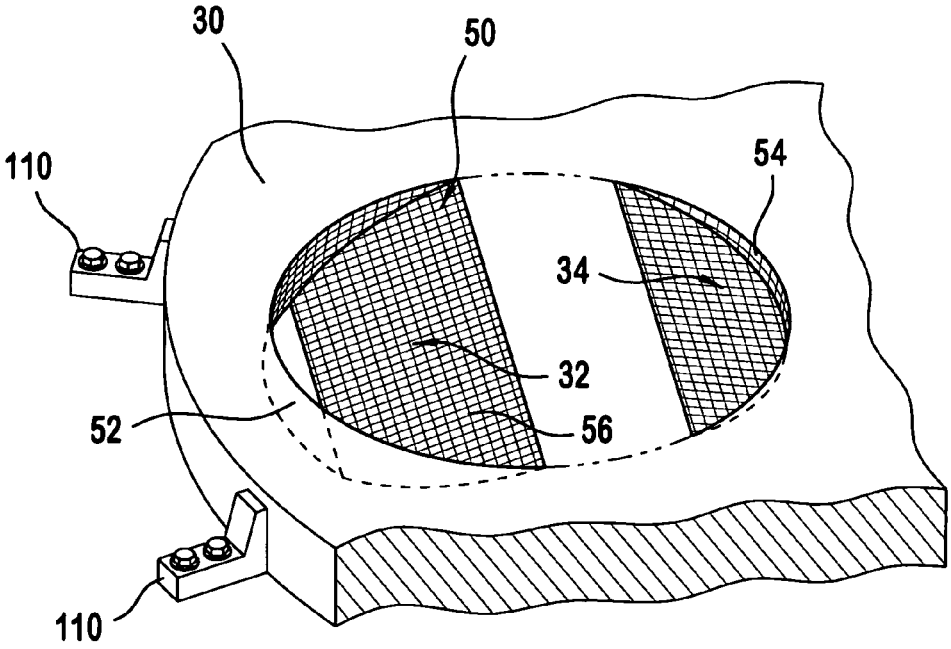
FIG. 4E

FIG. 4F
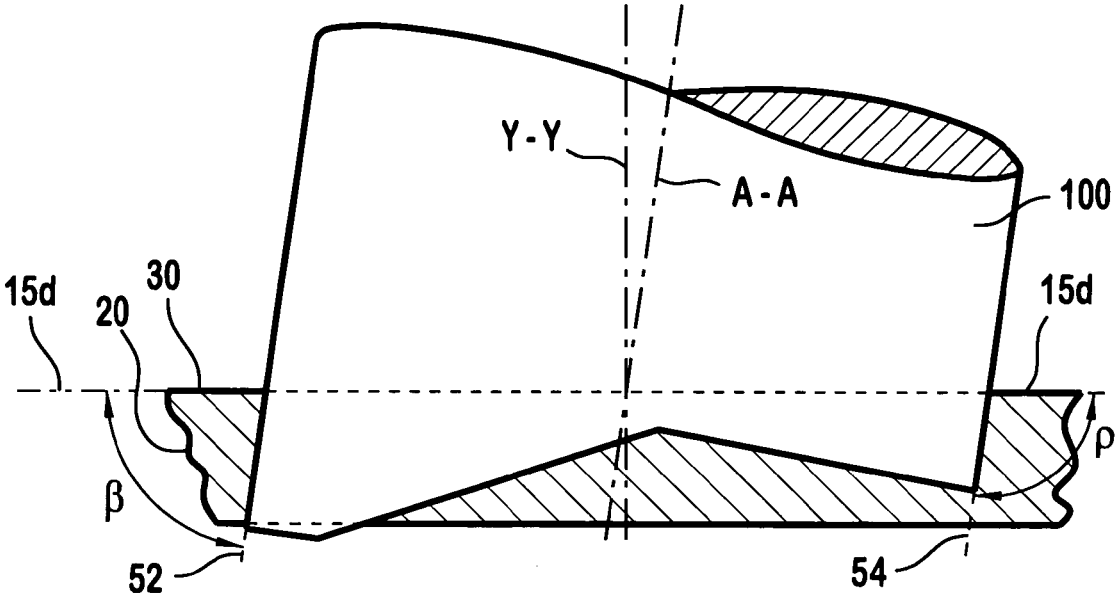
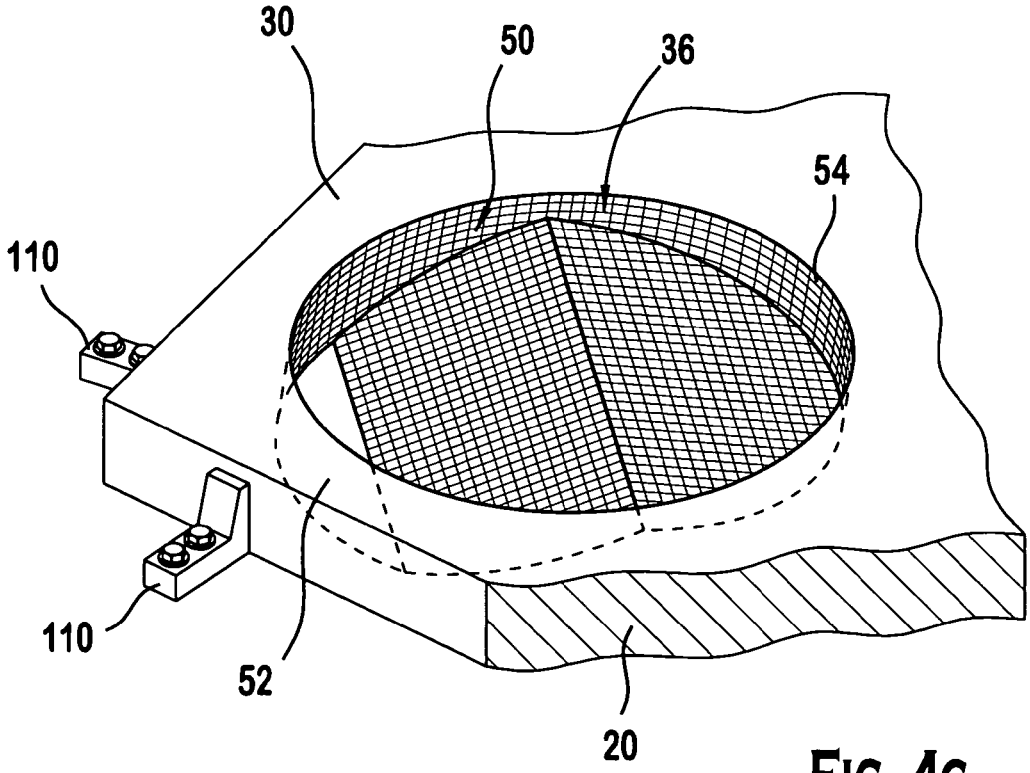
FIG. 4G

METHOD OF USING A TOOL TO FORM ANGLED ORIFICES IN A METERING ORIFICE DISC

FIELD OF INVENTION

This invention relates generally to a method of using a punch tool to form an orifice oriented at an angle less than 90 degrees with respect to a planar surface of a metering disc.

BACKGROUND OF THE INVENTION

It is believed that contemporary fuel injectors must be designed to accommodate a particular engine, not vice versa. The ability to meet stringent tailpipe emission standards for mass-produced automotive vehicles is at least in part attributable to the ability to assure consistency in both shaping and aiming the injection spray or stream, e.g., toward an intake an valve (or valves) or into a combustion cylinder. Wall wetting should be avoided.

Because of the large number of different engine models that use multi-point fuel injectors, a large number of unique injectors are needed to provide the desired shaping and aiming of the injection spray or stream for each cylinder of an engine. To accommodate these demands, fuel injectors have heretofore been designed to produce straight streams, bent streams, split streams, and split/bent streams. In fuel injectors utilizing thin disc orifice members, such injection patterns can be created solely by the specific design of the thin disc orifice member. This capability offers the opportunity for meaningful manufacturing economies since other components of the fuel injector are not necessarily required to have a unique design for a particular application, i.e. many other components can be of common design.

It is believed that known orifices can be formed in the following manner. A flat metering disc is formed with an orifice that extends generally perpendicular to the flat metering orifice disc, i.e., a "straight" orifice. In order to achieve a bending or split angle, i.e., an angle at which the orifice is oriented relative to a longitudinal axis of the fuel injector, the orifice can be formed by punching at an oblique angle relative to the longitudinal axis to provide an "angled orifice," i.e., an orifice angled with respect to the planar surface of the metering disc or a longitudinal axis extending perpendicularly between the flat surfaces of the disc.

It is believed that a known punch tool is formed of carbide and has a cylindrical body extending along a tool axis with a generally planar surface at a working end of the punch tool. The tool axis can be oriented at an angle oblique to the workpiece surface and a punching force can be applied to the punch along the tool axis so that the punch can penetrate through a blank workpiece. While the known punch tool has acceptable performance during the punching of a cylindrical orifice normal to the workpiece surface, the known punch tool has been observed to provide a less than desirable performance when the punch tool is used to form orifices extending oblique to the surface of the workpiece. In particular, the generally planar surface at the working end of the tool tends to break during the punching process. Even if the punch tool does not break during the angled orifice punching process, the punch tool may skip, slide, or deflect upon impact with the surface of the workpiece and therefore could cause the workpiece to be damaged and discarded. Further, the skipping, sliding, or deflecting of the punch could cause the workpiece to move laterally or vertically. To avoid the movements of the workpiece, a complex workpiece retention arrangement is utilized to ensure that the workpiece is stationary relative to a support surface.

Therefore, it would be desirable to provide for a punch tool that would have greater durability during the punching process for an angled orifice without resorting to complex or costly attempts in maintaining the same tool design or die design. Such attempts may include manufacturing the tool using exotic metals or an elaborate alignment and retention jig. It would also be desirable to provide for a punch tool that avoid skipping, sliding, or deflecting of the known punch tool during impact with a blank work strip.

SUMMARY OF THE INVENTION

The present invention provides for a method of using a tool to form an orifice through a workpiece. The workpiece has first and second generally planar surfaces spaced apart along a longitudinal axis. The method can be achieved by preventing lateral movement of a workpiece; extending a tool into the volume of material between the first and second generally planar surfaces of the workpiece to form first and second impressions in sequence, the first and second impressions being spaced apart about the longitudinal axis so that the first impression forms a first orifice wall extending between the first and second generally planar surfaces at an acute angle with respect to the first generally planar surface; and penetrating through the first generally planar surface to the other generally planar surface.

The present invention provides for a method of using a tool to form an orifice through a workpiece. The workpiece has first and second generally planar surfaces spaced apart along a longitudinal axis. The method can be achieved by preventing lateral movement of a workpiece; and forming first and second impressions in sequence in the volume of material between the first and second generally planar surfaces of the workpiece, the first and second impressions being spaced apart about the longitudinal axis so that the first impression forms a first orifice wall extending between the first and second generally planar surfaces at an acute angle with respect to the first generally planar surface.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

FIG. 4B illustrates a cross-sectional view of a pilot portion of the working end as it penetrates the surface of the workpiece.

FIG. 4C illustrates in an isometric view of the formation of the orifice in FIG. 4B without the preferred punch tool to show the particular characteristics of the orifice at the initial penetration stage of the preferred punch.

FIG. 4D illustrates a cross-sectional view of the penetration of the workpiece by various portions of the working end of the preferred embodiment of the punch tool.

FIG. 4E illustrates the formation of the orifice in FIG. 4D in an isometric view without the punch tool in order to illustrate the particular characteristics of the orifice at this stage of the punching process.

FIG. 4F illustrates a cross-sectional view of the penetration of the workpiece by various portions of the working end of the preferred embodiment of the punch tool.

FIG. 4G illustrates the formation of the orifice in FIG. 4D in an isometric view without the punch tool in order to illustrate the particular characteristics of the orifice at this stage of the punching process.

DETAILED DESCRIPTION OF THE PREFERRED EMBODIMENT

Figure 1A:
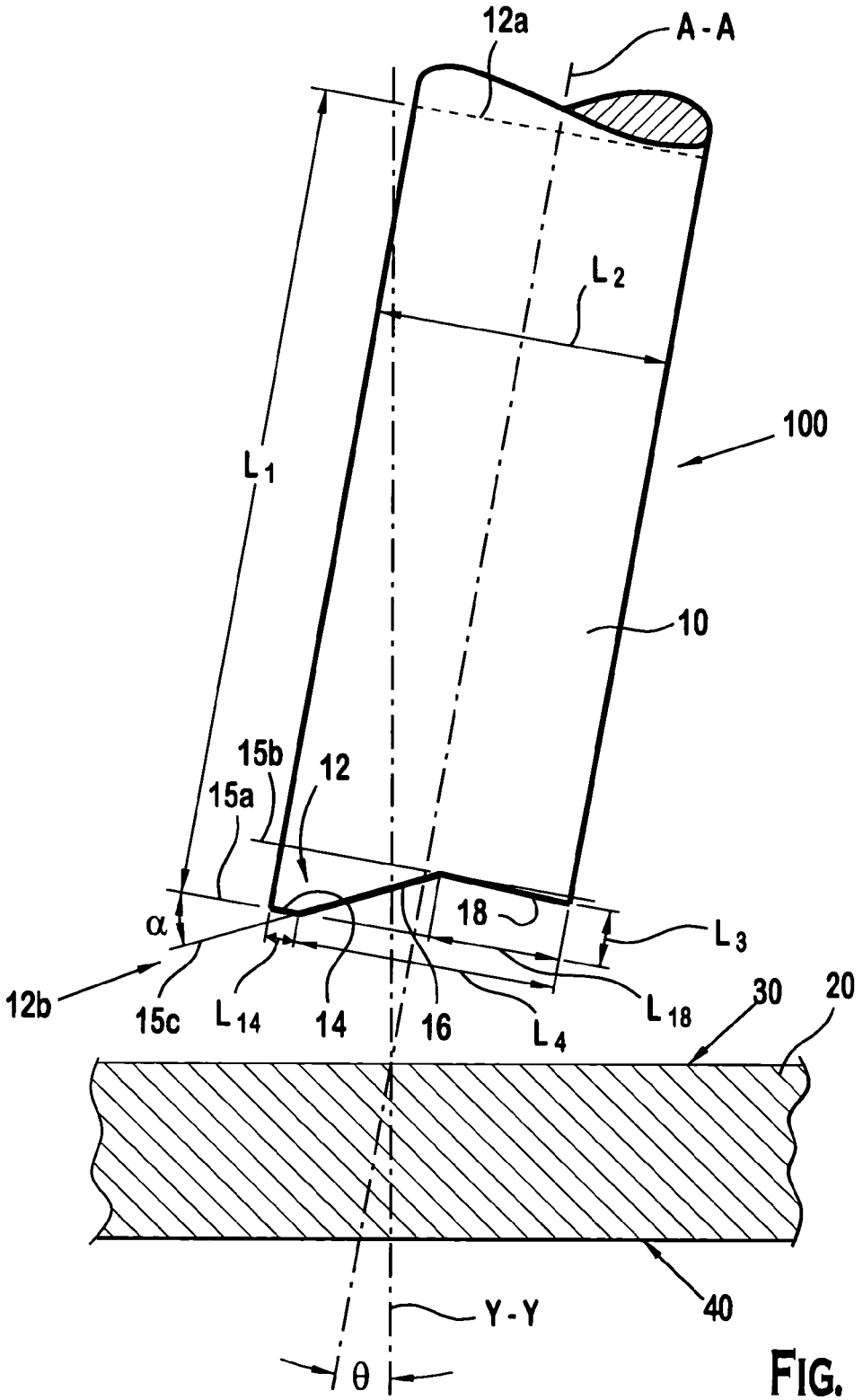
FIG. 1A is a cross-sectional view of a punch tool and a workpiece according to a preferred embodiment of the present invention.

FIGS. 1A-C, 2, and 4 illustrate the preferred embodiment. In particular, FIG. 1 depicts a punch tool 100 oriented at an angle θ with respect to a longitudinal axis Y-Y of a workpiece 20. The workpiece 20 has a first surface 30 and a second surface 40 that are preferably planar and parallel to each other and separated by a distance from 0.003 inches to 0.010 inches. In a preferred embodiment, the punch tool 100 can be formed from hardened tool steel and the punch tool 100 can be oriented at any one of an angle from three degrees to thirty degrees (3°-30°). In another preferred embodiment, tool steel or carbide with lubricity-enhancing or implanted coatings can be used to facilitate the punching process. Preferably, the workpiece 20 is of stainless steel blank strip with a thickness between the first and second surfaces 30, 40 of approximately 0.006 inches.

Figure 1B:
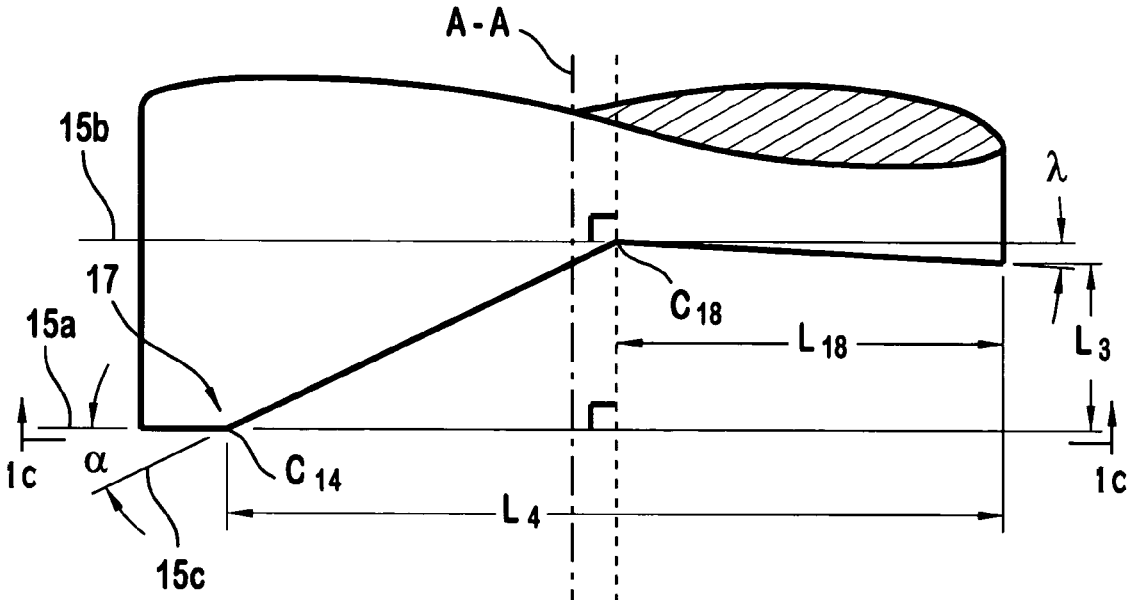
FIG. 1B is a close-up cross-sectional view of the punch tool of FIG. 1A.
Figure 1C:
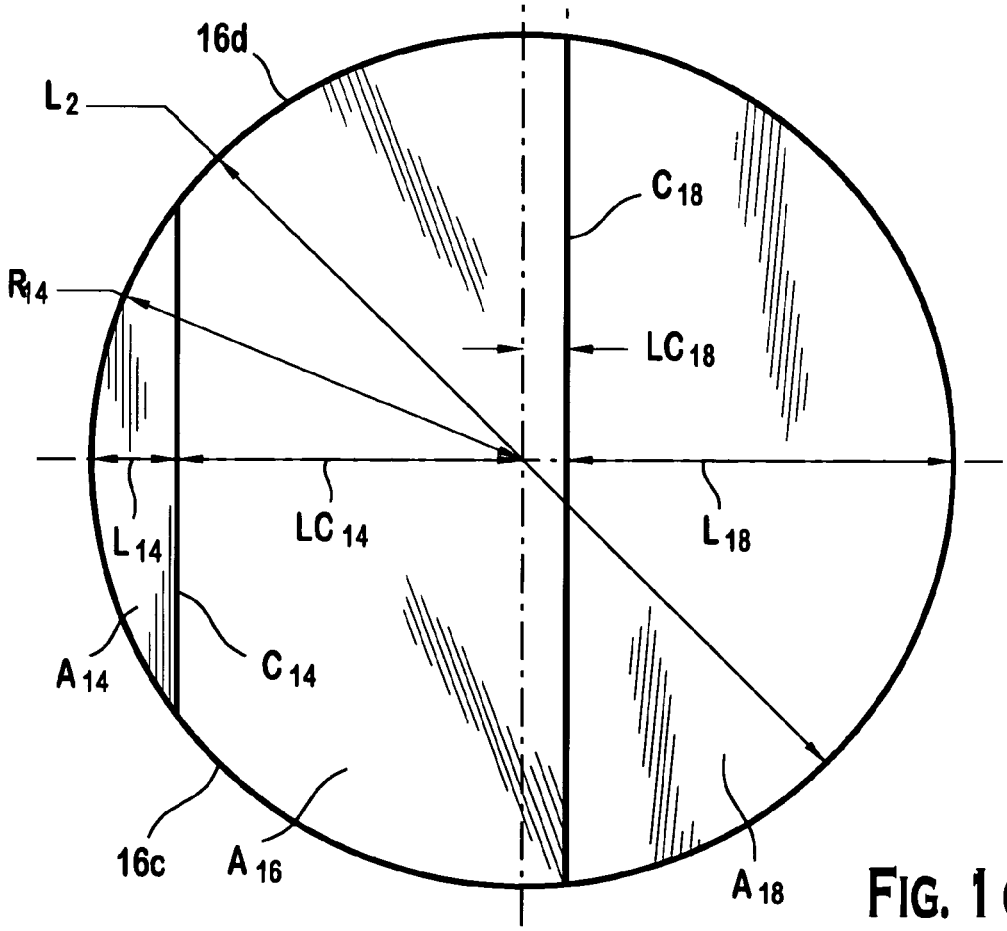
FIG. 1C is a planar view of the working end of the preferred embodiment of the punch tool of FIG. 1A.

Referring particularly to FIGS. 1A, 1B, 1C and 2, the punch tool 100 has a body portion 10 and a punching end 12. The body portion 10 can be an elongated member with a suitable cross-section, such as, for example, a circle, a rectangle, a square or an oval. The body portion 10 of the punch tool 100 can extend along the tool axis A-A over a distance $L_1$ between a first tool end 12*a* and a second tool end 12*b* (FIG. 1A). The body portion 10 preferably has a diameter $L_2$ of approximately 0.010 inches. Referring to FIGS. 1A and 1B, the second tool end 12*b* includes a pilot portion 14, a transition portion 16 and a main portion 18. Preferably, the elongated member has a circular section approximately a tool axis A-A (FIG. 1C). It is noted that in the following description, any reference to the dimensions should be understood to be the dimensions of the preferred embodiment with variations due to acceptable tolerances of these dimensions that will allow the preferred embodiment to function for its intended purpose in punching angled orifices and achieving specific orifice sizes or areas.

There are a number of design characteristics of the punch tool 100 that are believed to be advantageous in forming an angled orifice. Of particular emphasis are the pilot portion 14, transition portion 16 and main portion 18. The pilot portion 14 preferably has a semi-circular cross-sectional area disposed on a first virtual extension plane 15*a* and designate as a pilot area $A_{14}$ with a distance $L_{14}$. The main portion 18 is obliquely with respect to disposed second virtual extension plane 15*b* and preferably includes a semi-circular cross-section designated as a main area $A_{18}$ with a distance $L_{18}$. The transition portion 16 preferably includes curvilinear segments 16*c* and 16*d* of a truncated ellipse being disposed on a third virtual extension plane 15*c*.

The pilot portion 14 extends over a distance $L_3$ of about 0.020 inches from the outermost edge of the main portion 18. The distance $L_4$ between the pilot portion 14 and the farthest perimeter of the main portion 18 with respect to the pilot portion 14 is approximately 0.009 inches. The radius $R_{14}$ of the punch tool is approximately 0.005 inches with a chord $C_{14}$ located at approximately 0.0039 inches from the tool axis A-A when the chord $C_{14}$ is projected to a first virtual plane 15*a* contiguous to the surface area $A_{14}$, as seen in FIG. 1C. A distance between chord $C_{18}$ of the main portion 18 to the geometric center of the punch tool 100 is approximately 0.0006 inches when the chord $C_{18}$ and the center are projected onto second virtual plane 15*b*, as seen in FIG. 1C; a cut-back angle λ of the main portion 18 is approximately 3 degrees with respect to the second virtual plane 15*b*.

The pilot portion 14 preferably has a pilot surface area $A_{14}$ offset and generally orthogonal to the tool axis A-A of approximately $1.88\times10^{-5}$ square inches. As used herein, the term "offset" denotes that portions of the tool described herein do not intersect the tool axis A-A. Preferably, the main portion 18 is offset to the tool axis A-A with a main surface area $A_{18}$ of approximately $3.36\times10^{-5}$ square inches or approximately 1.8 times the pilot area $A_{14}$.

Figure 2:
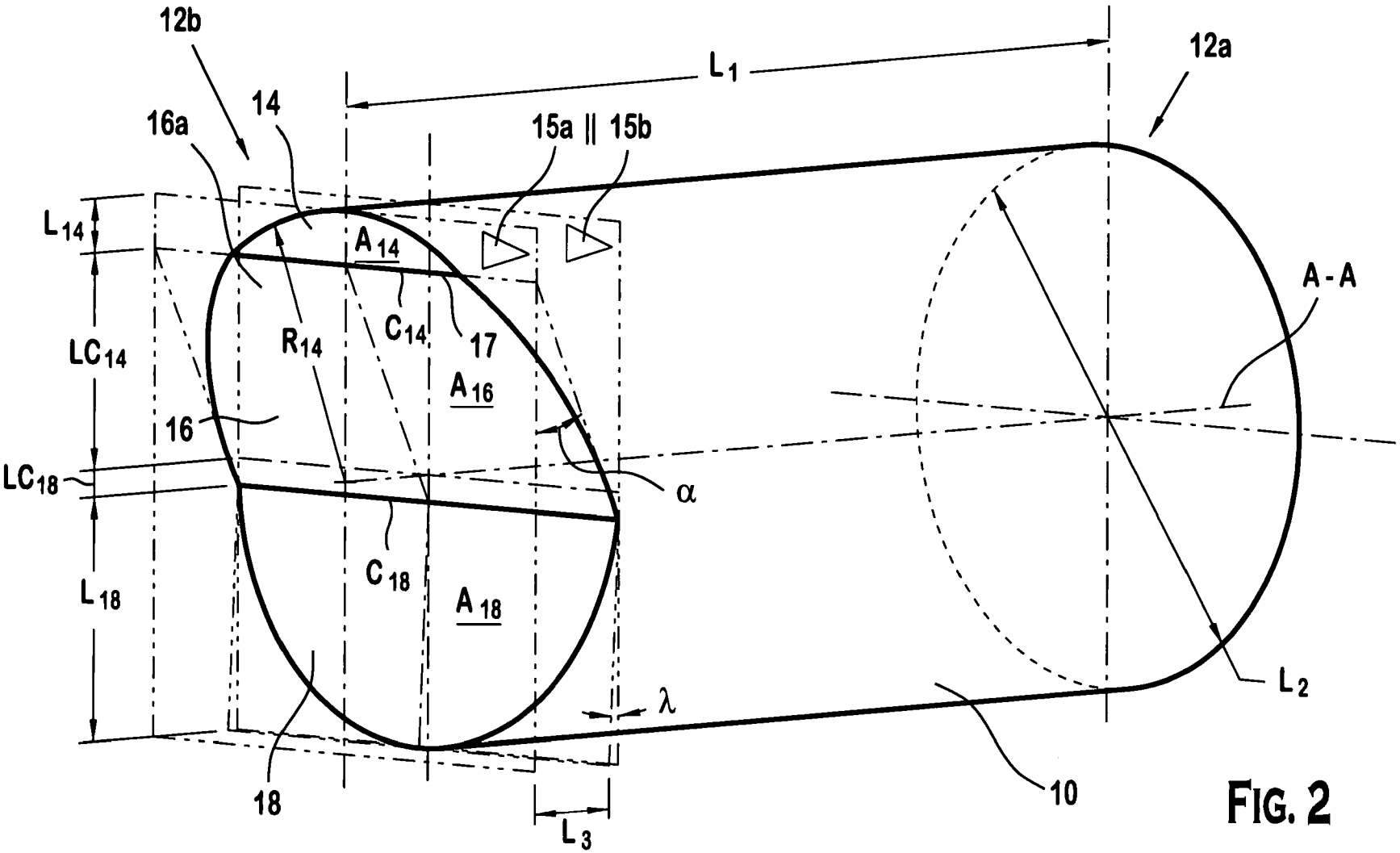
FIG. 2 is an isometric view of the working end of the preferred embodiment of the punch tool of FIG. 1A.

The surface area 16*a* of the transition portion 16 is disposed on the third plane 15*c* extends from the pilot portion 14 to the main portion 18 at a transition angle a of between 10 to 30 degrees as referenced to the first virtual extension plane 15*a* of the penetrating surface $A_{14}$ (FIGS. 1C and 2). Preferably, the transition portion 16 extends through the tool axis A-A with the transition angle α of approximately twenty-six (26°) degrees as referenced to the first virtual extension plane 15*a* and the cut-back angle λ is approximately ten percent of the transition angle α.

The design characteristics of the punch tool 100 are believed to be advantageous in forming angled orifices. In particular, because the pilot portion 14 is connected to the main portion 18 with the transition portion 16 at approximately 26 degrees, a juncture 17 (FIG. 4A) formed by an intersection of the pilot area $A_{14}$ and the transition area 16*a* to allow the juncture 17 to initially contact the surface of the workpiece 20. It is believed that this design characteristic of the tool 100 reduces the moment being applied to the punch tool 100, thereby tending to reducing the skipping or deflection of the tool 100. Furthermore, because the surface area $A_{14}$ of the pilot portion is approximately sixty percent of the main area $A_{18}$, the pilot portion 14 can apply a higher penetrating pressure to the workpiece 20. It is believed that this design characteristic permits the punch tool 100 to be guided deeper into the impact surface of the workpiece 20 prior to an actual cutting of the material of the workpiece 20. That is, by providing a pilot area of approximately sixty-percent to that of the main area, the punching force Fp is concentrated over a smaller area on the workpiece 20, thereby allowing the pilot portion 14 to securely penetrate into the workpiece 20.

Empirical evaluation has shown that the punch tool 100 reduces the rate of failure by ten times as compared to the known punch tool 200. As used herein, the term "failure" denotes damage either to the blank workpiece or to the punch tool such that either one may not be suitable for use as a metering orifice disc or a punch tool.

Figure 3:
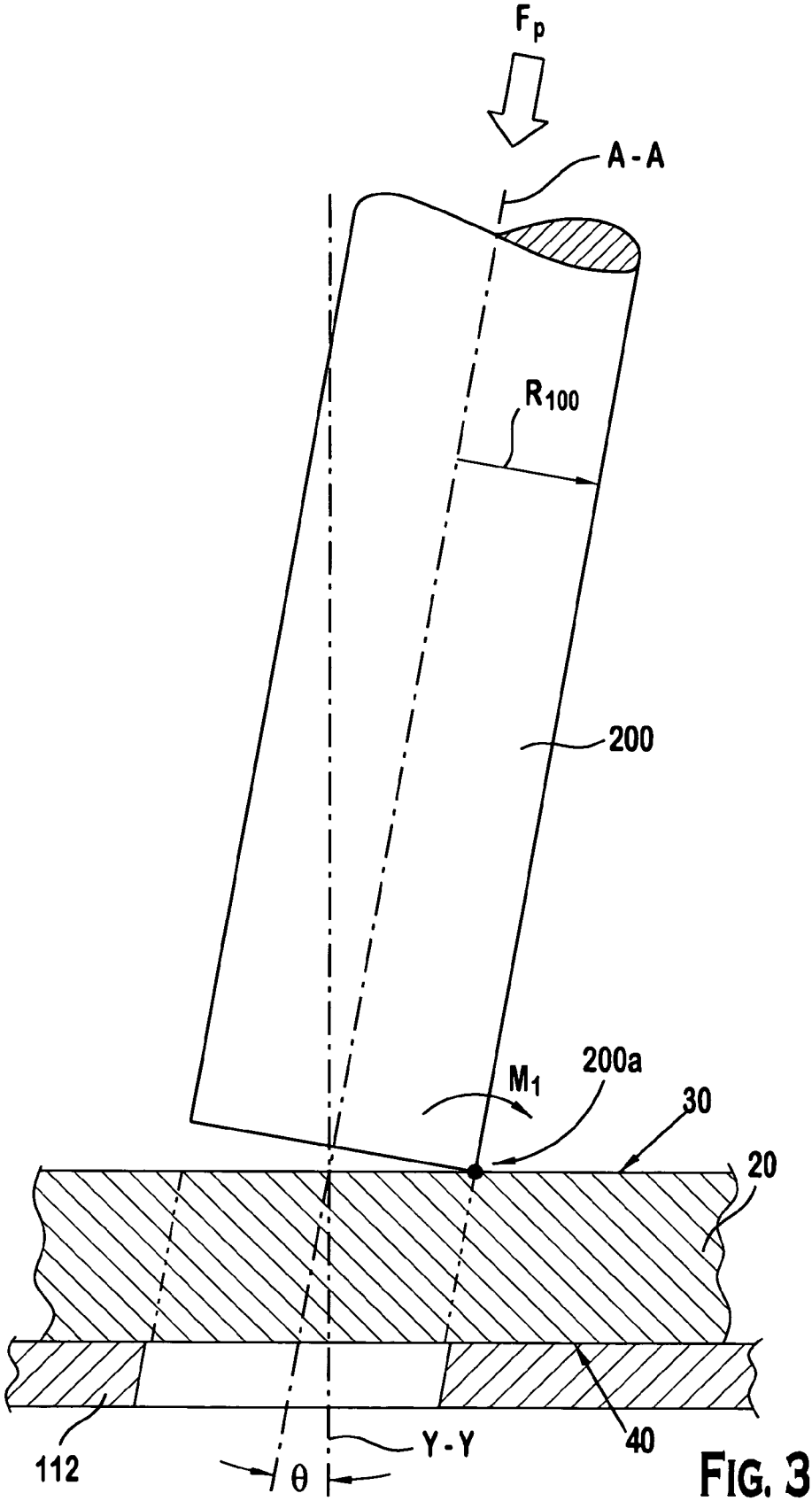
FIG. 3 is a cross-sectional view of a known punch tool and workpiece at a position prior to impact of the tool on the workpiece.
Figure 4A:
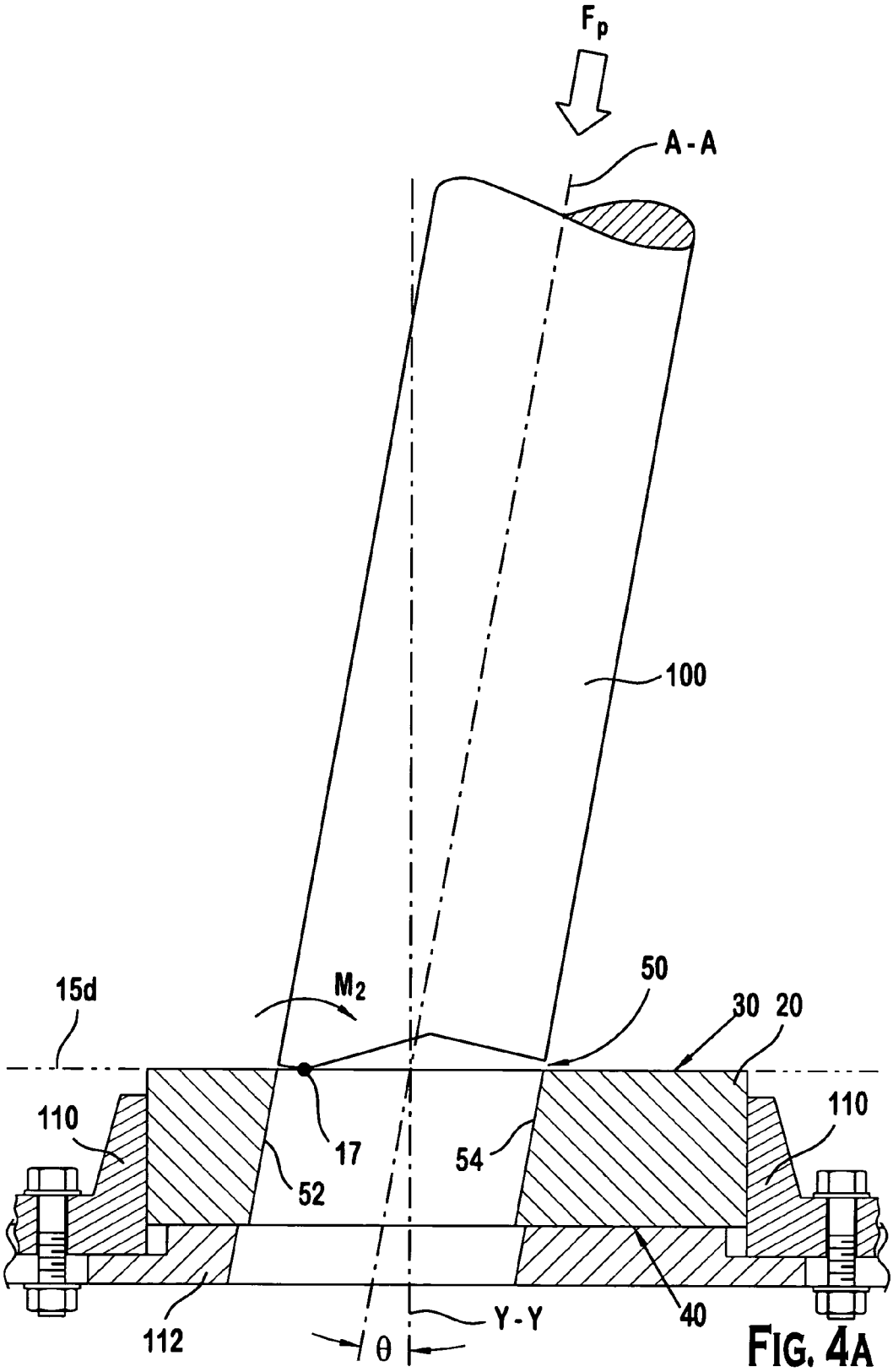
FIG. 4A is a cross-sectional view of the punch tool of the preferred embodiment prior to impact of the preferred embodiment of the punch tool on the workpiece.

FIGS. 3 and 4A-4G are provided to graphically demonstrate the benefits of these design characteristics of the preferred embodiment of the punch tool 100. In particular, FIGS. 3 and 4A illustrate that the preferred embodiment can reduce a moment or side loading as the punch tool 100 is being used to penetrate through the workpiece 20. In FIG. 3, the known punch tool 200 is depicted as being applied with a force Fp through a tool axis A-A of the known tool 200. The known tool 200 is also depicted at a position where an edge portion 200*a* is contiguous with the surface 30 of the workpiece 20. At this edge portion 200*a*, a pivoting edge can be formed by the known punch tool 200 that tends to rotate the tool 200 with a clockwise moment arm $M_1$, which is approximately equal to the force Fp acting through an engaged radius R (where $R_{100}$ being the maximum radius) as a function of the angle θ and the progression of the punch through the workpiece. In contrast, as depicted in FIG. 4A, the juncture 17 of the punch tool 100 of the preferred embodiment permits a smaller clockwise moment arm $M_2$ to be generated approximately a pivoting edge formed between the juncture 17 and the surface 30 of the workpiece. Thus, the smaller clockwise moment arm $M_2$ of the preferred embodiment tends to reduce side loading, deflection or skipping of the punch tool—as compared to the clockwise and larger moment arm $M_1$ of the known punch tool 200.

Moreover, the ratio of surface area of the pilot portion 14 as compared to the main portion 18 is believed to be advantageous because the punching force Fp is delivered over a smaller surface area of the pilot portion, thereby allowing the punch tool 100 to penetrate deeper into the surface 20 before a substantial amount of material removal takes place via the main portion 18 (FIG. 4C). As the punch tool 100 penetrates deeper into the material of the workpiece 20, the cut-back angle λ of the main portion 18 is believed to permit the punch tool 100 to be further secured to the workpiece, thereby reducing the propensity of the tool to skip, slide, or deflect despite the presence of a third clockwise movement $M_3$ (FIG. 4B) generated by the main portion 18.

In order for the punch tool 100 to penetrate the surface 30 of the workpiece 20 to form the angled orifice 50, the workpiece 20 must remain stationary via a preferred retention arrangement. To illustrate the advantages of the preferred retention arrangement, however, it is necessary to provide a brief description of the known arrangement as follows.

In the known punch tool and clamping arrangement, it has been observed that the workpiece has a propensity to move vertically or laterally with respect to the axis Y-Y upon the penetration and withdrawal of the known punch tool 200. To prevent such movement, the known clamping arrangement is designed to apply a clamping or spring force to the top surface of the workpiece along the longitudinal axis Y-Y against a support surface 112. By virtue of the vertical clamping force via a stripper plate (not shown for clarity as the stripper plate is known to those of ordinary skill in the art), the workpiece is prevented from moving vertically along the axis Y-Y away from the support surface 112. And by virtue of the vertical clamping force and coefficient of friction of the bottom surface 40 of the workpiece relative to the support surface 112 (FIG. 4A), the workpiece 20 is prevented from moving laterally and vertically. Thus, the known clamping arrangement prevents vertical movements with some degree of lateral movements permitted.

In contrast to the known clamping arrangement, the preferred workpiece retention arrangement prevents lateral movements and vertical movements. As illustrated pictorially in FIG. 4A, two or more stop members 110 positively abutting against the side surfaces of the workpiece 20 can be used to additionally prevent the slightest lateral movement of the workpiece 20. The advantages of the retention arrangement are believed to be due to the ability of the punch tool 100 to penetrate the surface 30 of the workpiece in a single operation without the tool 100 or workpiece 20 sliding, skipping or otherwise causing the workpiece 20 to bounce or move away from the support surface 112. Alternate arrangements other than the preferred stop member arrangement can also be utilized. For example, a holder disposed on support surface 112 to support the second surface 40 and the lateral sides of the workpiece, comically shaped spikes can be formed on the support surface 112 that engage the bottom surface 40 of the workpiece, or a separate holder arrangement with spikes that engage the support surface 112 can be used to prevent lateral movement of the workpiece 20 when the angled orifice 50 is being formed. The stop members can include a generally planar support surface connected to two wall surfaces extending generally parallel to the longitudinal axis Y-Y to form a workpiece holder, which wall surfaces can define a circular or polygonal perimeter to constrain the workpiece from lateral movements. Preferably, the workpiece is a blank strip of material having a length longer than its width with at least two lateral sides extending generally parallel to each other so that stop members can engage the respective lateral sides. In the preferred embodiment, the stop members are arranged on the lateral sides extending generally parallel to the longitudinal axis Y-Y.

Throughout the punching process of the angled orifice 50, several characteristics of an angled orifice 50 can be seen in FIGS. 4A-4G. Referring to FIG. 4A, the angled orifice 50 is depicted with wall surfaces 52 and 54 extending between the generally planar surfaces 30 and 40. The surface area $A_{50}$ of the orifice 50 can be generally equal to the cross-sectional area of the body 10 of the punch tool 100, which is preferably $7.85\times10^{-4}$ square inches. When the pilot portion 14 of the punch tool 100 has penetrated into a volume of material between the first surface 30 and the second surface 40, a first surface characteristic of the orifice 50 can be observed in FIG. 4C (shown without the punch tool for clarity). The surface on which the volume of material is displaced (e.g., compressed or plastically yielded) from the first surface 30 has a first surface area $A_{52}$ of generally approximately ¼ of the orifice surface area $A_{50}$. A wall 52 can be formed so that when measured with a virtual plane 15*d* contiguous to the surface 30, an acute angle β can be formed (FIG. 4B). The orifice at this stage has a first impression 32 defined by wall surfaces 52 surrounding the first surface area $A_{52}$ connected to a transition surface 56 that is connected to the first generally planar surface 30.

As the punch tool 100 is further extended into the material of the workpiece 20 as depicted in FIG. 4D, the surface area on which the punching force Fp is being distributed is increased in a generally linear manner between the initial penetration to partial penetration of the surface 30 due to the presence of the transition portion 16. At this point, another surface characteristic of the orifice 50 can be observed in an isometric view of FIG. 4E (shown without the punch tool for clarity). A second impression 34 in the surface 30 is now formed in addition to the first depression. The second depression 34 has wall surface 54 extending at an obtuse angle ρ relative to a fourth virtual plane 15*d*. Thus, two spaced-apart depressions or impressions 32 and 34 are formed in sequence during the process of reforming portion of the volume of material of the workpiece 20 to stamp or punch-forming the angled orifice.

As the punch tool 100 is yet further extended into the volume of material of the workpiece 20, the first and second depressions 32 and 34 become a single continuous depression 36. Finally, as the punch tool 100 is extended entirely through the second surface 40, this single continuous depression 36 becomes the angled orifice 50 with a continuous wall surface depicted in a cross sectional view of FIG. 4F as walls 52 and 54.

Thus, the preferred punch tool, retention arrangement, and method are believed to be advantageous because the service life of the punch tool is significantly longer as compared to the known punch tool and clamping arrangements. Consequently, the punching operation utilizing the preferred embodiment of the punch tool and retention arrangement can be more efficient.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What we claim is:

1. A method of using a tool to form an orifice through a workpiece having first and second generally planar surfaces spaced apart along a longitudinal axis with a volume of material therebetween, the method comprising:

preventing lateral movements of a workpiece with respect to a support surface;

extending a tool having a tool body comprising an elongated member having a circular cross-section defining a generally circular perimeter into the volume of material between the first and second generally planar surfaces of the workpiece to form first and second impressions in sequence, the first and second impressions being spaced apart about the longitudinal axis so that the first impression forms a first orifice wall extending between the first and second generally planar surfaces at an acute angle with respect to the first generally planar surface; and penetrating through the first generally planar surface to the other generally planar surface;

wherein, the preventing lateral movements comprises orientating the tool having a tool axis oblique to one of the generally planar surfaces, the tool having a pilot work surface spaced from a main work surface, the pilot work surface facing the first generally planar surface of the workpiece and being disposed on a first virtual plane, the pilot work surface comprising an area bounded by a first arcuate portion of the perimeter of the tool body and a first chord connecting the first arcuate portion;

the extending comprises penetrating into the first generally planar surface with the pilot work surface and the main work surface such that the area penetrated by the pilot work surface has an area less than the area penetrated by the main work surface; and the penetrating comprises projecting a transition work surface into the first generally planar surface of the workpiece, the transition work surface extending through the tool axis at a first oblique angle with respect to a second virtual plane contiguous to the pilot work surface.

2. The method of claim 1, wherein the orientating comprises positioning the tool body at any angle from about three to about thirty degrees.

3. The method of claim 1, wherein the main work surface comprises an area bounded by a second arcuate portion of the perimeter of the tool body and a second chord connecting the second arcuate portion.

4. The method of claim 1, wherein the transition work surface comprises a surface having a first arcuate outer perimeter connecting adjacent ends of the first and second chords and a second arcuate perimeter connecting the other adjacent ends of the first and second chords.

5. The method of claim 1, wherein the first oblique angle comprises any angle between ten to thirty degrees.

6. The method of claim 5, wherein the first oblique angle is approximately 26 degrees.

7. The method of claim 1, wherein the extending comprises projecting the main work surface into the generally planar surface of the workpiece, the main work surface extending at a second oblique angle to the first virtual plane, the second oblique angle being approximately ten percent of the first oblique angle.

8. The method of claim 1, wherein the preventing comprises providing at least one stop member on the support surface, the stop member engaging a lateral surface of the workpiece to prevent lateral movement with respect to the longitudinal axis.

9. The method of claim 1, wherein the preventing of lateral movements comprises providing pointed projections on the support surface that engage the other generally planar surface of the workpiece to prevent lateral movements thereof.

10. The method of claim 1, wherein the penetrating comprises removing material of the workpiece so that a second orifice wall is formed between the first and second generally planar surfaces at an obtuse angle with respect to the second virtual plane.

11. The method of claim 10, wherein the acute angle is any angle from approximately 80 to approximately 87 degrees, and the obtuse angle is any angle from approximately 93 to approximately 100 degrees.

12. The method of claim 1, wherein the penetrating comprises applying a force along the tool axis of the tool body comprising a tool steel material.

13. A method of using a tool to form an orifice through a workpiece having first and second generally planar surfaces spaced apart along a longitudinal axis with a volume of material therebetween, the method comprising:

preventing lateral movements of a workpiece with respect to a support surface;

extending a tool into the volume of material between the first and second generally planar surfaces of the workpiece to form first and second impressions in sequence, the first and second impressions being spaced apart about the longitudinal axis so that the first impression forms a first orifice wall extending between the first and second generally planar surfaces at an acute angle with respect to the first generally planar surface; and penetrating through the first generally planar surface to the other generally planar surface:

wherein, the preventing lateral movements comprises orientating the tool having a tool axis oblique to one of the generally planar surfaces, the tool having a pilot work surface spaced from a main work surface, the pilot work surface facing the first generally planar surface of the workpiece;

the extending comprises penetrating into the first generally planar surface with the pilot work surface and the main work surface such that the area penetrated by the pilot work surface has an area less than the area penetrated by the main work surface; and the main work surface area comprises an area approximately 1.8 times greater than the pilot work surface area.

* * * * *